US006093077A

United States Patent [19]

Spector

[11] Patent Number: 6,093,077

[45] **Date of Patent: *Jul. 25, 2000**

[54] HEAD-LIKE PNEUMATIC PLAY BALL

[76] Inventor: Donald Spector, 380 Mountain Rd., Union City, N.J. 07087

[ * ] Notice: Under 35 U.S.C. 154(b), the term of this patent shall be extended for 13 days.

[21] Appl. No.: 08/630,669

[22] Filed: Apr. 10, 1996

[51] Int. Cl.[7] ..... A63H 3/06; A63B 43/02

[52] U.S. Cl. ..... 446/226; 473/596; 473/603

[58] Field of Search ..... 446/220, 226, 446/223, 225, 391; 273/65 EG, 58 BA, 65 B; 473/603, 596, 599, 604, 609, 610

[56] References Cited

U.S. PATENT DOCUMENTS 3,923,304 12/1975 Warren ..... 473/471

*Primary Examiner*—Mickey Yu

[57] ABSTRACT

A pneumatic play ball that looks like the head of a humanoid, an animal-like or fanciful figure whereby a player who kicks this ball is then metaphorically kicking the figure. The play ball is composed of an inflated rubber balloon confine within and conforming to the inner surface of a generally spherical hollow casing. The casing is molded of a soft, flexible material whose outer surface is contoured to define the features of the head whereby the ball resembles the decapitated head of the figure.

3 Claims, 1 Drawing Sheet

HEAD-LIKE PNEUMATIC PLAY BALL

BACKGROUND OF INVENTION

1. Field of Invention

This invention relates generally to pneumatic playballs in which an inflated bladder is confined within an outer casing, and more particularly to a playball of this type which has the appearance of the decapitated head of a humanoid, an animal-like or fanciful figure.

2. Status of Prior Art

Though small children are attracted to conventional athletic balls and enjoy watching adults play soccer and other ball games, in the hands of a small child these balls are heavy and dangerous, especially in indoor play. The standard inflated athletic ball has a relatively large diameter and a smooth, hard outer casing which makes it difficult for a small child to grasp, throw and catch.

The toy and game industry has long recognized the need for a lighter, softer and potentially less dangerous ball for young children. Thus, balls in various shapes and sizes are now commercially available which are molded of polyurethane foam material and other lightweight compressible plastics. While such balls are safe in the hands of pre-school children and will inflict no injury even if the ball is hurled toward the body of another child, they fail in many respects to satisfy the typical child's desire for a ball that looks like a real athletic ball of the type used by adults, that is bouncy and not an unconvincing substitute for a regulation ball.

U.S. Pat. No. 5,035,426 to Spector discloses a pneumatic playball that has the configuration and appearance of a standard pneumatic athletic ball, such as a regulation basketball. Yet the Spector ball is much lighter and therefore in the hands of young children is safer to play with, especially in indoor play. Despite its light weight, the ball is exceptionally strong. And when not in use, the Spector ball may be collapsed into a highly compact form.

The Spector ball is constituted by an outer casing and an inner inflatable bladder confined within the casing. The outer casing is formed by contoured segments of high strength, non-stretchable fabric material stitched together to create, when the casing is fully expanded, a play ball of the desired shape and size, such as a football or soccer ball. The inner bladder is a conventional thin-skin rubber balloon whose stem initially projects through a port in the casing.

After the balloon is inflated with air so that it conforms to the casing, the stem is then tied into a knot to seal the balloon, and the tied stem is pushed into the casing under the port. Because the balloon is fully encased, no portion thereof can be extruded from the casing when the ball is bounced and the internal pressure within the balloon is increased.

An unconfined rubber balloon has little strength and is easily burst. But when the inflated balloon is confined within a non-stretchable fabric casing, even though the balloon, per se, is inherently weak, because the casing does not permit any region of the balloon to further expand beyond its existing degree of expansion, the balloon will not burst even if a heavy adult sits on the ball or the ball is given a hard kick.

The bounce characteristics of a pneumatic ball is a function of its internal air pressure. Thus in a standard tennis ball, when the internal air pressure is reduced as a result of gradual air leakage, the ball becomes "dead" and then has insufficient bounce for the game.

The reason the Spector ball has high bounce characteristics is that its internal air pressure is much higher than in a conventional beach ball made of a non-stretchable plastic film. A conventional beach ball offers little resistance to expansion until fully inflated, at which point, since the material is non-stretchable, it cannot be further inflated. But with a stretchable rubber balloon, it takes much more air pressure to stretch the rubber from its initial state to its stretched and fully inflated state, as a consequence of which the internal air pressure of the balloon in the Spector ball is much higher than in a conventional beach ball.

The term "kick" has either a literal or figurative meaning and in some instances the two meanings are merged. Thus when a ball is kicked, it is literally struck, for the kicker's foot then makes contact with the ball. But if you kick someone around, you are then treating him badly, not actually striking him. Thus President Nixon is remembered for his remark to the press that they would not have him around to kick anymore.

When however one kicks someone who is down, this combines a physical act with a deliberate insult, for the individual who is down is unable to retaliate and the act of kicking him is an expression of contempt.

Perhaps the earliest example of a kick that is both a physical act and an insult is in the soccer game invented by the Inca Indians of South America who used as a soccer ball a skull separated from an eneny's body. A player in kicking this skull, thereby insulted the spirit of the enemy.

In the course of history, decapitated heads had served as symbols. Thus in the Middle Ages it was the tradition to put on display the decapitated heads of executed criminals, this serving as a public warning. And in ancient Rome, Roman soldiers in a victory parade would carry decapitated enemy heads on poles.

The present invention which provides a pneumatic play ball that resembles a decapitated head, constitutes what is referred to in the toy and plaything trade as a "gross" toy. A gross toy, by its very nature, is one that adults may find disgusting. Yet a gross toy is appealing to children for perhaps the same reason that children enjoy "Horror" movies repugnant to adults. Thus currently on the toy market are play balls having a transparent casing enclosing a plastic core molded to resemble a human intestine or brain.

Also currently available in the toy and plaything market are so-called "overhead masks." These take the form of rubber or plastic hoods with eye and mouth holes that are designed to go over the head of an individual and to resemble the head of a monster or other gruesome figure. Halloween overhead masks of this type often resemble human skulls.

SUMMARY OF INVENTION

In view of the foregoing, the main object of this invention is to provide a pneumatic play ball which resembles the decapitated head of a humanoid, an animal-like or fanciful figure.

A significant feature of a ball in accordance with the invention is that it is exceptionally bouncy; hence when the head-like ball is kicked by a player, its trajectory is long and the decapitated head appears to be flying.

More particularly, an object of this invention is to provide a head-like play ball having a generally spherical molded casing of flexible material in which is confined an inflated balloon, the outer surface of the casing being contoured to define the features of the decapitated head.

Briefly stated, these objects are attained by a pneumatic play ball that looks like the head of a humanoid, an animal-like or fanciful figure whereby a player who kicks this ball is then metaphorically kicking the figure. The play ball is composed of an inflated bladder or rubber balloon confined within and conforming to the inner surface of a generally spherical hollow casing. The casing is molded of a relatively, soft flexible material whose outer surface is contoured to define the features of the head whereby the ball resembles the decapitated head of the figure.

The casing includes a slit to admit the balloon in its deflated state, the neck of the balloon then projecting from the slit to permit mouth inflation of the balloon to cause it to expand and conform to the inner surface of the casing, the balloon then having a relatively high internal air pressure to render the ball bouncing. The neck is then tied to seal the balloon and pushed into the casing so that the ball is then in condition for play.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

Figure 2:
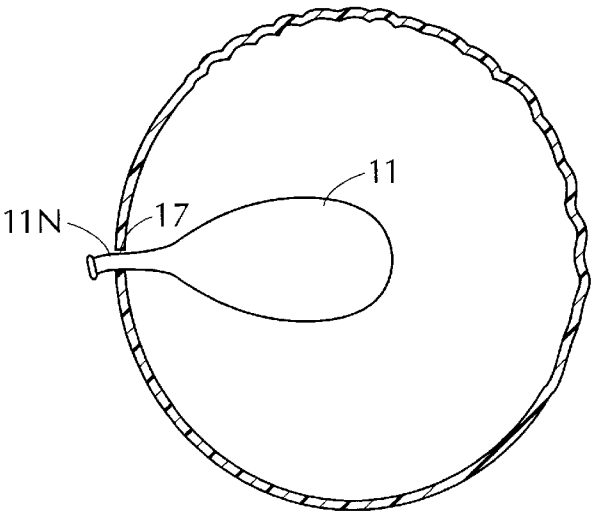
FIG. 2 is a section taken through the casing showing the balloon in a deflated state in condition to be inflated.
Figure 1:
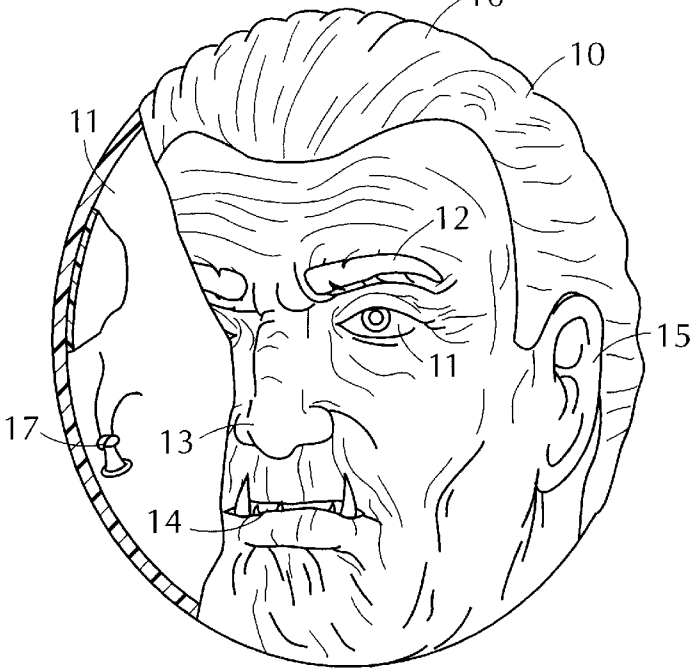
FIG. 1 is a perspective view of one embodiment of a head-like pneumatic play ball in accordance with the invention, partly cut away to expose the inflated balloon enclosed within the casing of the ball.

Referring now to FIGS. 1 and 2, there is shown a preferred embodiment of a head-like playball in accordance with the invention formed by an outer casing 10 and an inflated rubber balloon 11 confined within the casing.

Casing 10 which is generally spherical in shape is molded of a soft and flexible material, such as latex, PVC, neoprene, closed-cell, flexible foam plastic material, such as polyurethane, or of materials in current use to mold overhead masks.

Casing 10 which is generally spherical in shape is molded so that its inner surface is smooth, but its outer surface is sculpted by grooves, raised ridges, and other impressions which together define the features of a decapitated head of a humanoid, an animal-like or fanciful figure. Thus the figure could be that of a monster, or of a gorilla. Or the figure could be that of a well-known cartoon or animated film character.

The head shown in FIG. 1, by way of illustration only, is that of a monster whose eyes and eyebrows 12, nose 13, mouth 14, ears 15 and hair 16 are created by the impressions molded in the outer surface of the casing. This head is preferably pigmented in a manner calculated to render it more gruesome, so that the hair may be white, the skin light brown, the exposed teeth, some white, others black, and the nose and ears reddish.

Casing 10, as best seen in FIG. 2, which is otherwise impermeable to air and liquids, is provided with a small slit 17 on one side of the head so that it is inconspicuous.

Slit 17 which is normally slightly open is easily dilated to admit into casing 10 the balloon 11 in its deflated state, as shown in FIG. 2. In this condition, the stem or neck 11N of the balloon projects from the slit so that the balloon may be mouth inflated and expanded until it conforms to the inner surface of casing 10.

After the balloon is fully inflated, then in order to seal the balloon to retain the pressurized air therein, one ties neck 11N into a knot. The knotted neck is pushed under casing slit 17 as shown in FIG. 1, and now the neck no longer projects from the slit. Casing slit 17 is under tension in that the casing is subjected to tension by the inflated rubber balloon which because of the high internal pressure seeks to expand but is prevented from doing so by the casing. By reason of this tension, slit 17 is then forced to recover its almost fully closed state, thereby encasing the balloon.

With an unconfined balloon, should one squeeze the balloon or subject it to pressure, then as the balloon is depressed in the region t o which the pressure is applied, the resultant compression of the internal air will force the balloon skin to stretch in the unpressed regions thereof, and if the applied pressure is heavy, the balloon may burst. Thus, if an unconfined balloon is inflated to its maximum safe diameter, say, a one-foot diameter, and the balloon is squeezed to cause it to assume a figure-of-eight pattern, the resultant stretching of the rubber skin which takes place in the unpressured regions of the balloon may exceed the safe limit and cause the balloon to burst .

But in a ball in accordance with the present invention, the balloon is confined by the casing and regardless of how the balloon is handled, the balloon is not permitted to expand within the confines of the casing beyond its maximum safe diameter. We have found that an encased balloon has exceptional strength, far greater than that of an unconfined balloon or a balloon confined within a stretchable casing. Indeed, tests have shown that the ball, when subjected to hundreds of pounds of pressure, will not burst. Thus if a heavy adult sits on the ball, it will sustain this load.

A significant advantage of a ball in accordance with the invention in which the bladder is an ordinary rubber balloon as compared to a conventional beach ball which uses a non-stretchable inflatable plastic sphere, is that the former has a much higher internal air pressure than the latter and therefore considerably more bounce. The reason for this difference is that when blowing up a non-stretchable plastic ball, it takes little air pressure to do so, for the ball offers virtually no resistance to expansion until it is fully expanded. But with a rubber balloon, it takes much more air pressure to stretch the rubber from the original deflated form of the balloon to its fully stretched state.

The high-bounce characteristics of the head-like playball renders it highly responsive to a kicking force, and when the ball is kicked, it has a long trajectory and the decapitated head then appears to be flying.

Figure 3:
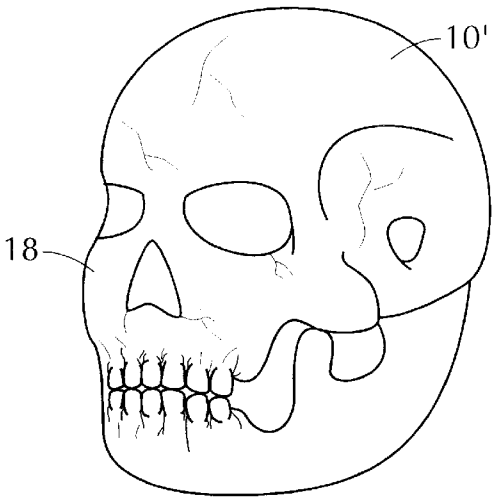
FIG. 3 shows another embodiment of the playball.

In the embodiment of the play ball shown in FIG. 3, the casing 10' is molded to create a human skull 18 so that as in the game of soccer as played by the Inca Indians, one may in effect kick a skull rather than a conventional soccer ball.

While there has been shown preferred embodiments of a head-like pneumatic play ball in accordance with the invention, it is to be understood that many changes may be made therein without departing from the spirit of the invention. Thus it is not essential to the invention that the play ball be generally spherical, for the casing which defines the decapitated head of a humanoid, an animal-like or fanciful figure may have somewhat oval or globular shape closer in form to the head of the figure from which it is derived. But in all cases, the sculpted projections on the outer surface of the casing which define the features of the figure are close to this outer surface and do not stick out prominently therefrom say in the manner in which human ears stick out from the head, for this would interfere with the ability to play with the decapitated head as if it were a ball. And in lieu of a rubber balloon one may use a conventional bladder having a valved inlet.

I claim:

1. A pneumatic play ball in a kickable size that looks like the head of a humanoid, an animal-like or fanciful figure, said playball comprising:

A. a spherically shaped hollow casing molded of flexible foam plastic material, said casing having a smooth spherical inner surface and an irregular outer surface contoured to define the features of the head of the figure; and B. a bladder confined within the casing and inflated therein to conform to the spherical inner surface of the casing whereby the resultant pneumatic ball resembles a decapitated head of the figure which is kickable by a player who is then metaphorically kicking the figure, the playball having a diameter close to that of a soccer ball or a basketball, said bladder being a rubber balloon, said casing being provided with a slit to admit into the casing the balloon in its deflated state, said balloon having a neck which projects from the slit for mouth inflation, after which the neck is tied and pushed under the slit.

2. A play ball as set forth in claim 1, in which the head resembles that of a monster.

3. A play ball as set forth in claim 1, in which the head resembles that of a human skull.

* * * * *